US007555874B2

(12) United States Patent
Chu

(10) Patent No.: US 7,555,874 B2
(45) Date of Patent: Jul. 7, 2009

(54) CASE SEALING APPARATUS WITH MULTIPLE OPERATIONAL MODES

(75) Inventor: William Yiu Tong Chu, Vancouver (CA)

(73) Assignee: Wexxar Packaging Inc., Delta, British Columbia (CA)

( * ) Notice: Subject to any disclaimer, the term of this patent is extended or adjusted under 35 U.S.C. 154(b) by 0 days.

(21) Appl. No.: 11/853,874

(22) Filed: Sep. 12, 2007

(65) Prior Publication Data

US 2009/0064636 A1 Mar. 12, 2009

(51) Int. Cl.
*B65B 57/00* (2006.01)

(52) U.S. Cl. ..... 53/75; 53/136.4; 53/377.2; 493/183

(58) Field of Classification Search ..... 53/75, 53/76, 491, 136.4, 137.2, 377.2, 387.2; 493/116, 493/117, 183, 478; 156/212, 468, 483, 486, 156/584

See application file for complete search history.

(56) References Cited

U.S. PATENT DOCUMENTS

| | | | | |
|---|---|---|---|---|
| 3,686,052 | A | 8/1972 | Nelson | |
| 3,894,380 | A | 7/1975 | Poulsen | |
| 4,515,579 | A | 5/1985 | Beckett | |
| 4,517,784 | A | 5/1985 | Beckett | |
| 4,542,616 | A | 9/1985 | Ulrich et al. | |
| 4,543,150 | A | 9/1985 | Marchetti | |
| 4,545,175 | A | 10/1985 | Beckett | |
| 4,545,176 | A | 10/1985 | Marchetti | |
| 4,585,504 | A | 4/1986 | Marchetti | |
| 4,643,707 | A * | 2/1987 | Marchetti | 493/117 |
| 4,748,794 | A | 6/1988 | Marchetti | |
| 4,821,203 | A | 4/1989 | Carlton et al. | |
| 5,374,326 | A * | 12/1994 | Marchetti | 53/137.2 |
| 5,480,371 | A * | 1/1996 | Morita et al. | 493/117 |
| 5,511,362 | A | 4/1996 | Morita et al. | |
| 5,794,417 | A | 8/1998 | Mohrman | |
| 5,916,106 | A * | 6/1999 | Chen | 53/377.2 |
| 6,067,773 | A | 5/2000 | Le | |
| 6,135,937 | A * | 10/2000 | Ballos, III | 493/117 |
| 6,481,664 | B1 | 11/2002 | Bravin | |
| 6,702,728 | B1 * | 3/2004 | Ballos, III | 493/117 |
| 6,910,314 | B2 | 6/2005 | Le | |

* cited by examiner

*Primary Examiner*—Louis K Huynh
(74) *Attorney, Agent, or Firm*—Thompson Hine LLP

(57) ABSTRACT

A case sealing apparatus includes a frame structure including a case conveyance path extending from a case infeed station to a case outfeed station. First and second side conveying units extend between the infeed station and the outfeed station. The first and second side conveying units are moveable toward and away from the conveyance path for engaging opposite sides of cases to move cases of various widths from the infeed station toward the outfeed station. A lower tape head assembly is positioned along the conveyance path to apply tape to case bottoms. The lower tape head assembly is movable between a lowered position for taping and a raised position for changing tape. An upper tape head assembly is positioned along the conveyance path to apply tape to case tops. The upper tape head assembly is vertically movable to accommodate cases of various heights. A control system controls movement of the first and second side conveying unit, the upper tape head assembly and the lower tape head assembly. The control system includes one or more of a multi-size case mode, a case size lock mode and a tape change mode.

18 Claims, 8 Drawing Sheets

CASE SEALING APPARATUS WITH MULTIPLE OPERATIONAL MODES

TECHNICAL FIELD

The present application relates to packaging apparatus and more particularly to a case sealing apparatus including multiple operational modes.

BACKGROUND

Case sealing apparatus are known for taping or gluing flaps of a case closed. Some of the known case sealing apparatus can accept cases of varying heights and widths. For example, U.S. Pat. No. 4,542,616 describes an apparatus having a vertically moveable tape head assembly and side arm assemblies that are moveable toward and away from each other. The tape head assembly is used to tape the top of the case closed.

SUMMARY

In an aspect, a case sealing apparatus includes a frame structure including a case conveyance path extending from a case infeed station to a case outfeed station. First and second side conveying units extend between the infeed station and the outfeed station. The first and second side conveying units are moveable toward and away from the conveyance path for engaging opposite sides of cases to move cases of various widths from the infeed station toward the outfeed station. A lower tape head assembly is positioned along the conveyance path to apply tape to case bottoms. The lower tape head assembly is movable between a lowered position for taping and a raised position for changing tape. An upper tape head assembly is positioned along the conveyance path to apply tape to case tops. The upper tape head assembly is vertically movable to accommodate cases of various heights. A control system controls movement of the first and second side conveying unit, the upper tape head assembly and the lower tape head assembly. The control system includes a multi-size case mode, a case size lock mode and a tape change mode. During the multi-size case mode, the control system operates such that the first and second side conveying units and the upper tape head assembly are moved each time a case is fed through the machine for taping. During the case size lock mode, the control system maintains the upper tape head assembly and the first and second side conveying units in locked positions so that multiple cases of common size can be fed through the apparatus at increased throughput as compared to during the multi-size case mode. During the tape change mode, the control system raises the lower tape head assembly from the lowered position to the raised position to facilitate changing of tape.

In another aspect, a case sealing apparatus a frame structure including a case conveyance path extending from a case infeed station to a case outfeed station. First and second side conveying units extend between the infeed station and the outfeed station. The first and second side conveying units are moveable toward and away from the conveyance path for engaging opposite sides of cases to move cases of various widths from the infeed station toward the outfeed station. A lower tape head assembly is positioned along the conveyance path to apply tape to case bottoms. An upper tape head assembly is positioned along the conveyance path to apply tape to case tops. The upper tape head assembly is vertically movable to accommodate cases of various heights. A control system controls movement of the first and second side conveying units and the upper tape head assembly. The control system includes a multi-size case mode and a case size lock mode. During the multi-size case mode, the control system operates such that (i) the first and second side conveying units and the upper tape head assembly are located at respective initial positions until presence of a case at the infeed station is detected, (ii) the upper tape head assembly is moved vertically into a taping position for taping the top of the case and the first and second side conveying units are moved sidewardly into respective side positions for engaging opposite sidewalls of the case to move the case along the conveyance path and (iii) after taping the upper tape head assembly and the first and second side conveying units are moved back to their respective initial positions to prepare for handling of a next case. During the case size lock mode, the control system maintains the upper tape head assembly and the first and second side conveying units in locked positions so that multiple cases of common size can be fed through the apparatus at increased throughput as compared to during the multi-size case mode, wherein the case size lock mode is triggered via user activation of a user input during handling of a case in the multi-size case mode after the upper tape head assembly has moved to the taping position for the case and the first and second side conveying units have been moved into their respective side positions for the case.

In another aspect, a case sealing apparatus includes a frame structure including a case conveyance path extending from a case infeed station to a case outfeed station. At least one conveying unit is provided for moving cases from the infeed station to the outfeed station. A lower tape head assembly is positioned along the conveyance path to apply tape to case bottoms. The lower tape head assembly is movable between a lowered position for taping and a raised position for changing tape. A control system is provided for controlling operation of the conveying unit and movement of the lower tape head assembly. The control system includes at least one case sealing mode and a tape change mode. During the case sealing mode, the lower tape head assembly is maintained in its lowered position as cases are moved from the infeed station to the outfeed station via operation of the conveying unit. During the tape change mode, the control system raises the lower tape head assembly from the lowered position to the raised position to facilitate changing of tape.

The details of one or more embodiments are set forth in the accompanying drawings and the description below. Other features, objects, and advantages will be apparent from the description and drawings, and from the claims.

DETAILED DESCRIPTION

Figure 1:
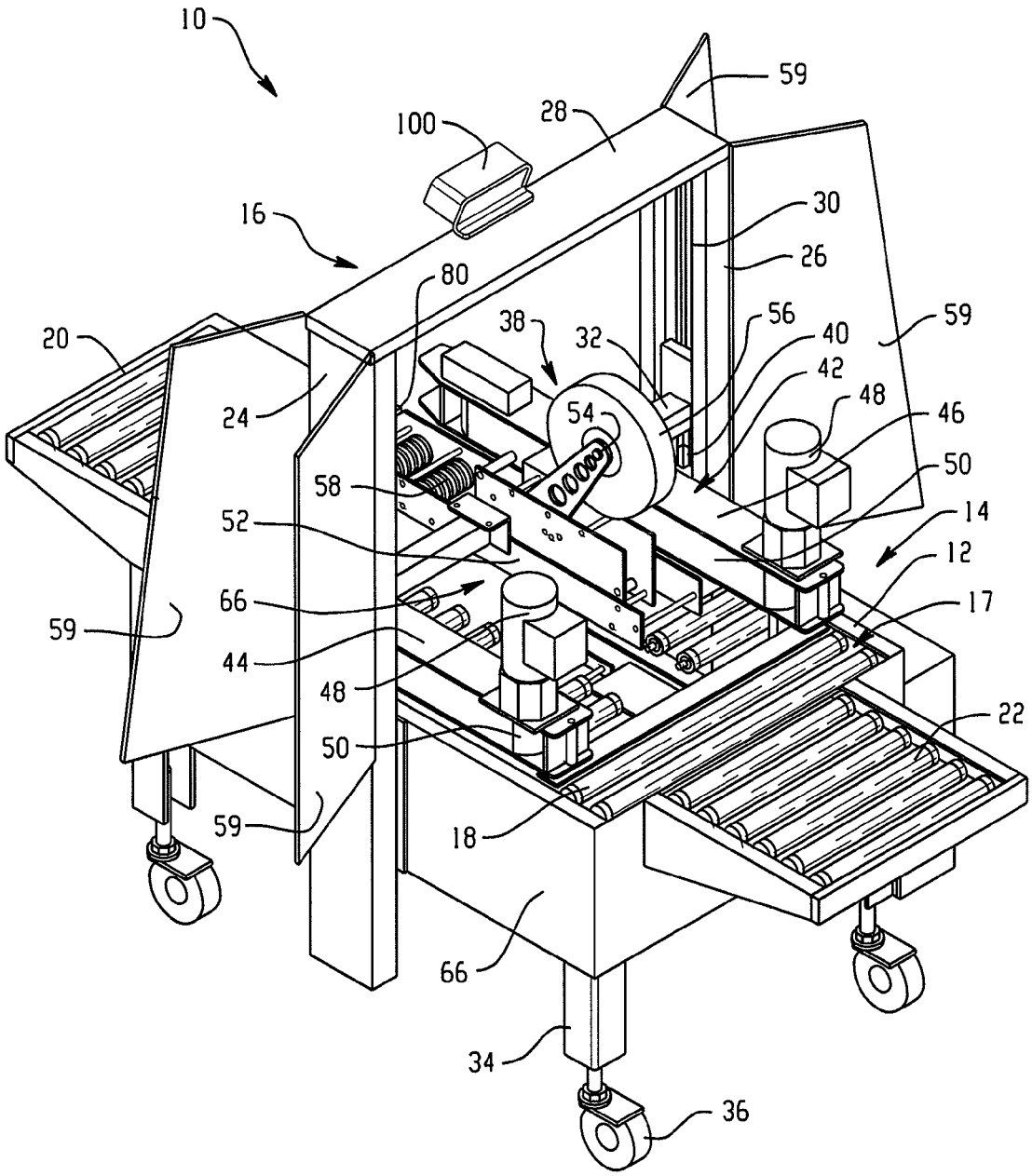
FIG. 1 is a perspective view of an embodiment of a case sealing apparatus.

Referring to FIG. 1, a case sealing apparatus 10 is provided that accommodates cases of various sizes and that provides increased throughput of similarly or same size cases therethrough. As will be described in greater detail below, the case sealing apparatus 10 has multiple modes including a multi-size case mode for sealing cases of varying dimensions, a case size lock mode for sealing cases having substantially the same dimensions and a tape change mode for increased tape accessibility.

The case sealing apparatus 10 includes a frame 12 with a conveyor portion 14 and a tape head support portion 16. Conveyor portion 14 includes a conveyor bed 17. In the illustrated embodiment, the conveyor bed 17 includes a series of horizontally aligned rollers 18, however, other conveyor elements can be used such as balls, or even a low friction, flat surface material. The conveyor portion 14 also includes an infeed conveyor table 20 and an outfeed conveyor table 22. The infeed and outfeed conveyor tables 20 and 22 each include their own series of aligned rollers 18 and each cooperates with the conveyor bed 17 to deliver cases onto and off of the conveyor bed. In some embodiments, the frame includes legs 34 with rollers 36 for ease in moving the case sealing apparatus 10 from one location to another.

The tape head support portion 16 includes vertical members 24 and 26 and a horizontal member 28 connecting the vertical members. The vertical members 24 and 26 each include a track 30 along which a tape head support beam 32 travels up and down. Tape head support beam 32 is used to support an upper tape head assembly 38 and is moved vertically using linear actuators 40 (e.g., pneumatic cylinders) located at each vertical member 24 and 26.

The case sealing apparatus 10 utilizes a conveyor system, generally designated 42, to move cases through the apparatus. The conveyor system 42 includes side conveyors 44 and 46. The side conveyors 44 and 46 include a motor 48 that is used to move an endless belt 50. The endless belts 50 of the side conveyors 44 and 46 cooperate to move cases through the case sealing apparatus.

The side conveyors 44 and 46 are moveable toward and away from each other to accommodate cases having different widths in the cross-conveying direction. In some embodiments, the side conveyors 44 and 46 are moved toward and away from each other using a pneumatic cylinder. In many embodiments, the side conveyors 44 and 46 are linked together such that they move together substantially the same distance to maintain a center point between the side conveyors. Maintaining the center point between the side conveyors 44 and 46 can keep cases centered under the tape head assembly 38 as they pass thereby.

Tape head assembly 38 includes a support bracket 52 connected to the tape head support beam 32. The support bracket 52 is used to support a tape head 54 with tape 56 at a downstream side of the tape head support portion 16 and an array of compression rollers 58 at an upstream side of the tape head support portion.

In some embodiments, doors 59 are provided with each door having an open and closed configuration. The doors 59, in the illustrated embodiment, are hingedly connected to the vertical members 24 and 26. The doors 59 can inhibit (provide a barrier against) operator access to the tape head assembly 38 in their closed configurations and can allow operator access to the tape head assembly in their open configurations.

Figure 2:
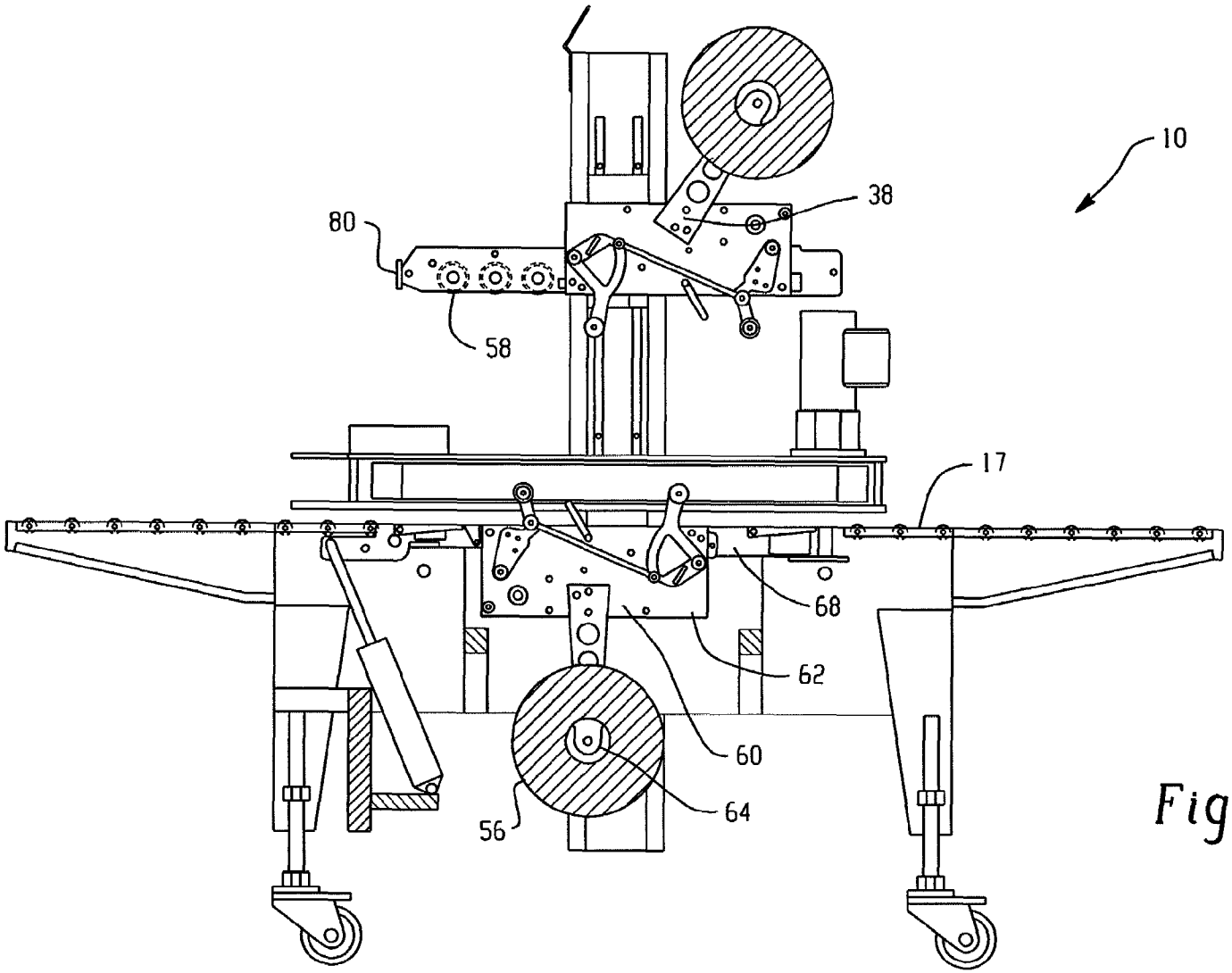
FIG. 2 is a section view of the case sealing apparatus of FIG. 1.

Referring now to FIG. 2, the case sealing apparatus 10 also includes a lower tape head assembly 60. The lower tape head assembly 60 seals bottom flaps of the case together as it passes thereby. The lower tape head assembly 60 includes a support bracket 62 that supports a tape head 64 with tape 56 located beneath the conveyor bed 17. Referring briefly back to FIG. 1, an opening 66 is provided in the conveyor bed 17. This opening 66 is sized so that the lower tape head 64 can be repositioned above the conveyor bed 17 during the tape change mode, for example, to replace a spent roll of tape with a new roll of tape with relative ease. This is accomplished, in part, by rotatably mounting the support bracket 62 to a fixed lower support structure 68 located at the opening 66.

Figure 3:
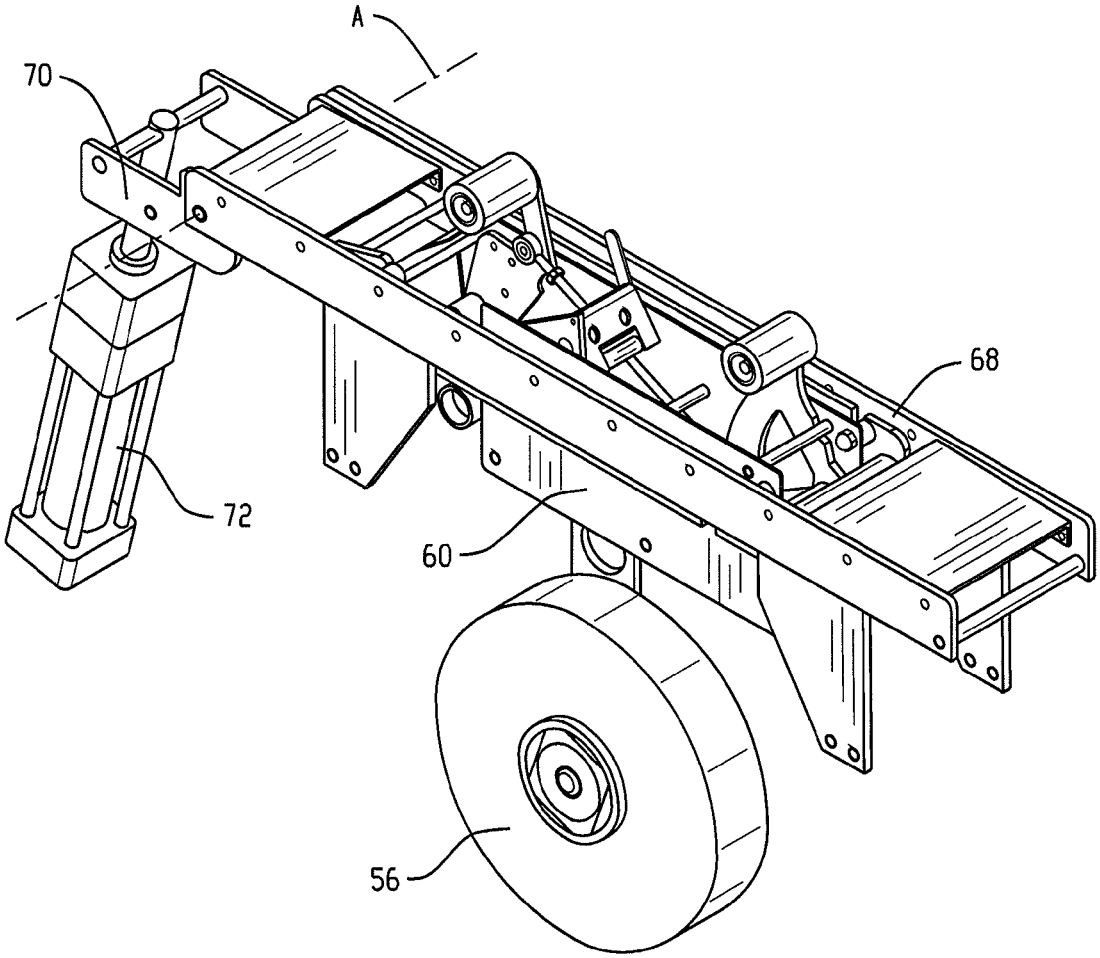
FIG. 3 is a perspective view of an embodiment of a lower tape head assembly for use in the case sealing apparatus of FIG. 1 in a lowered position.
Figure 4:
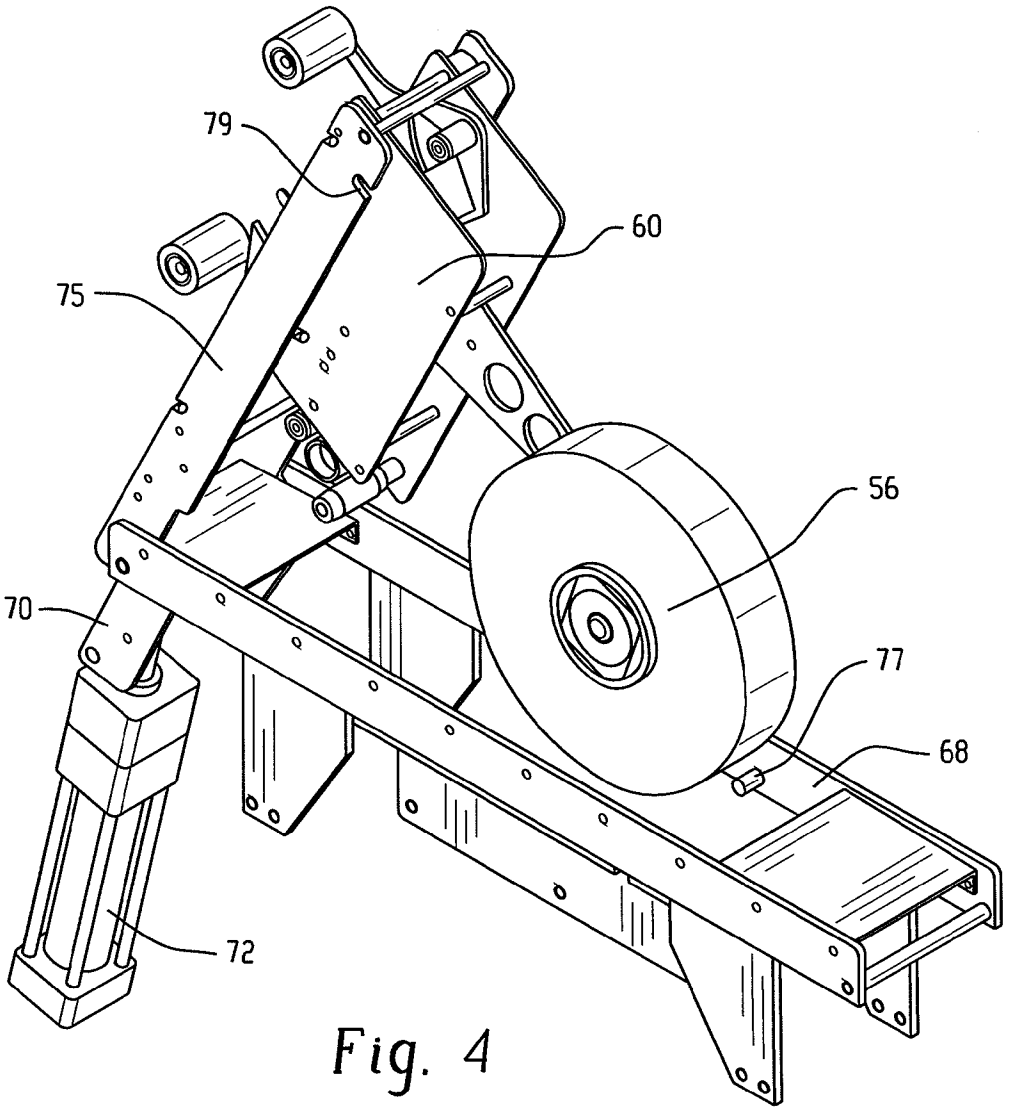
FIG. 4 is a perspective view of the lower tape head assembly of FIG. 3 in a tape change mode.
Figure 5:
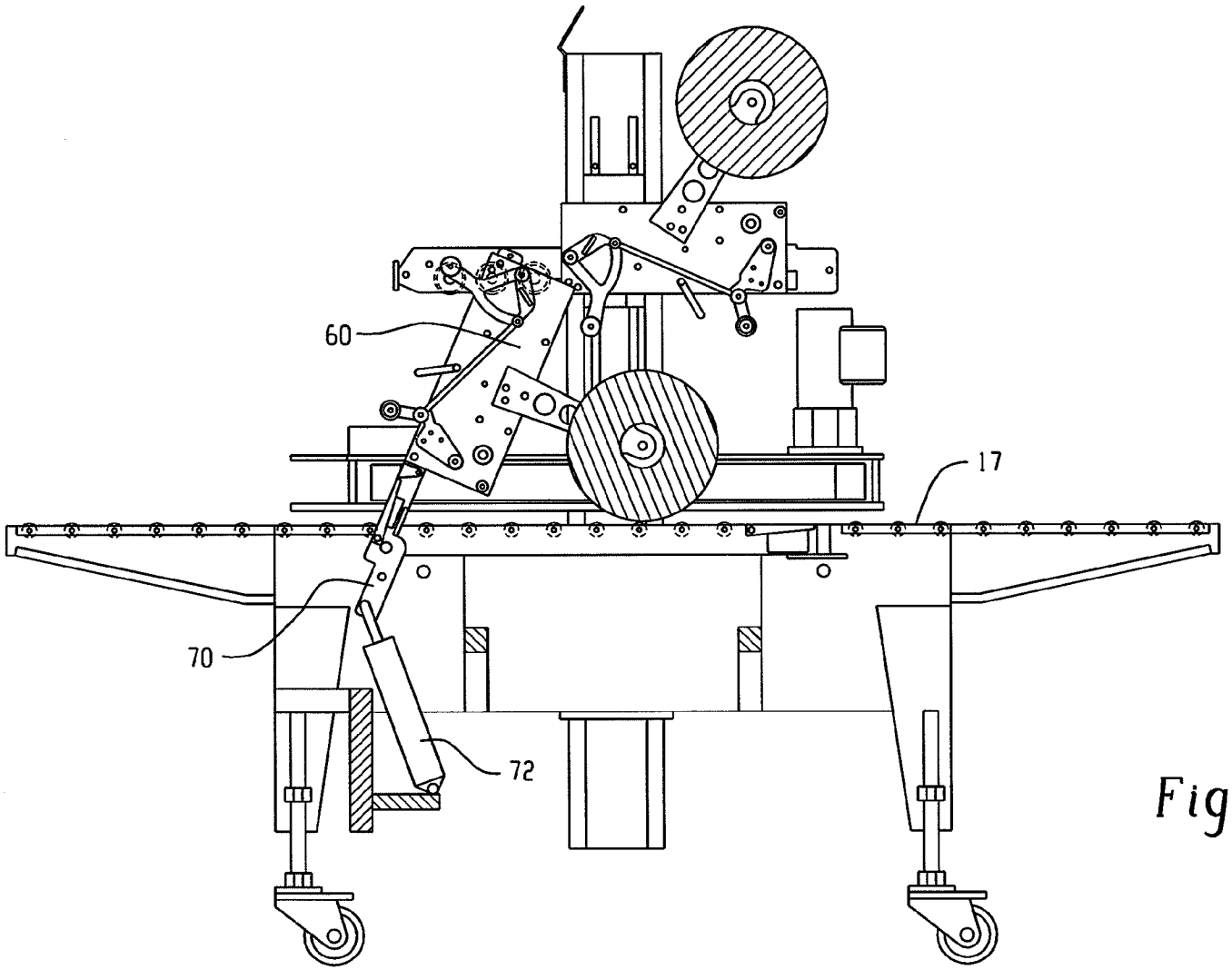
FIG. 5 is a section view of the case sealing apparatus of FIG. 1 with the lower tape head assembly in the tape change mode.

FIG. 3 shows the lower tape head assembly 60 and lower support structure 68 in isolation. The lower tape head assembly 60 is rotatably mounted to the lower support structure 68 to provide a pivot axis A. A linkage 70 connects the lower tape head assembly 60 to an actuator, in this instance, pneumatic cylinder 72. Referring to FIGS. 4 and 5, retraction of the pneumatic cylinder 72 moves the lower tape head assembly 60 such that at least part of the lower tape head assembly is located above the conveyor bed 17. In some embodiments, in the raised position, the tape 56 of the lower tape head 64 is positioned entirely above the conveyor bed 17. When the lower tape head assembly is lowered by extending the cylinder 72, rotating bracket 75 rests on projection 79 with the projection located in notch 79.

By providing the tape change mode, an operator need not somehow access the tape head 64 from beneath the case sealing apparatus 10 in order to access the tape 56. As can be seen by FIG. 1, this can be particularly advantageous where the case sealing apparatus 10 includes a housing 66 or other protective covering that shields the lower tape head assembly 60 from the operator in its lowered, operating position.

Figure 6:
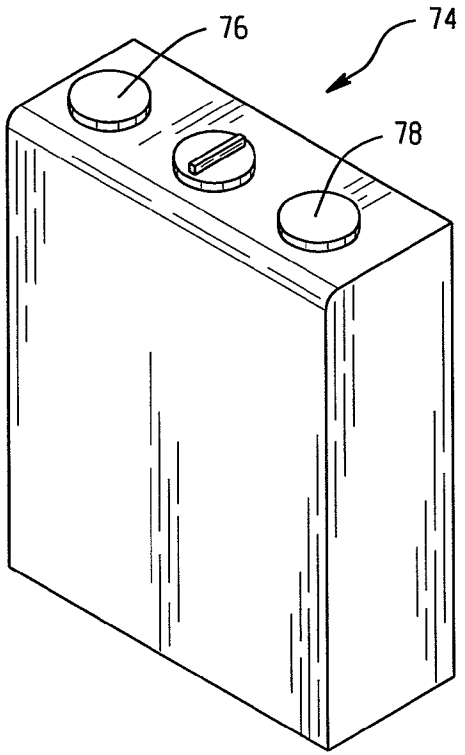
FIG. 6 is a perspective view of an embodiment of a user input device for controlling the case sealing apparatus of FIG. 1 by placing the case sealing apparatus in the tape change mode.

Referring to FIGS. 5 and 6, the pneumatic cylinder 72 may be operated using an operator input device 74, for example, including a control box having multiple inputs, one input 76 (e.g., a button) for retracting the cylinder and lifting the lower tape head assembly 60 and one input 78 for extending the cylinder and lowering the lower tape head assembly. Although shown in isolation, the operator input device 74 may be mounted to the frame 12, for example, on one side of the frame. In some embodiments, operation of the pneumatic cylinder 72 may be linked to operation of the upper tape head assembly 38, which is described in greater detail below. For example, it may be possible to retract the pneumatic cylinder 72 and raise the lower tape head assembly 60 only after the upper tape head assembly 38 has been raised, e.g., so that the upper tape head assembly does not interfere with raising the lower tape head assembly.

Figure 7A:
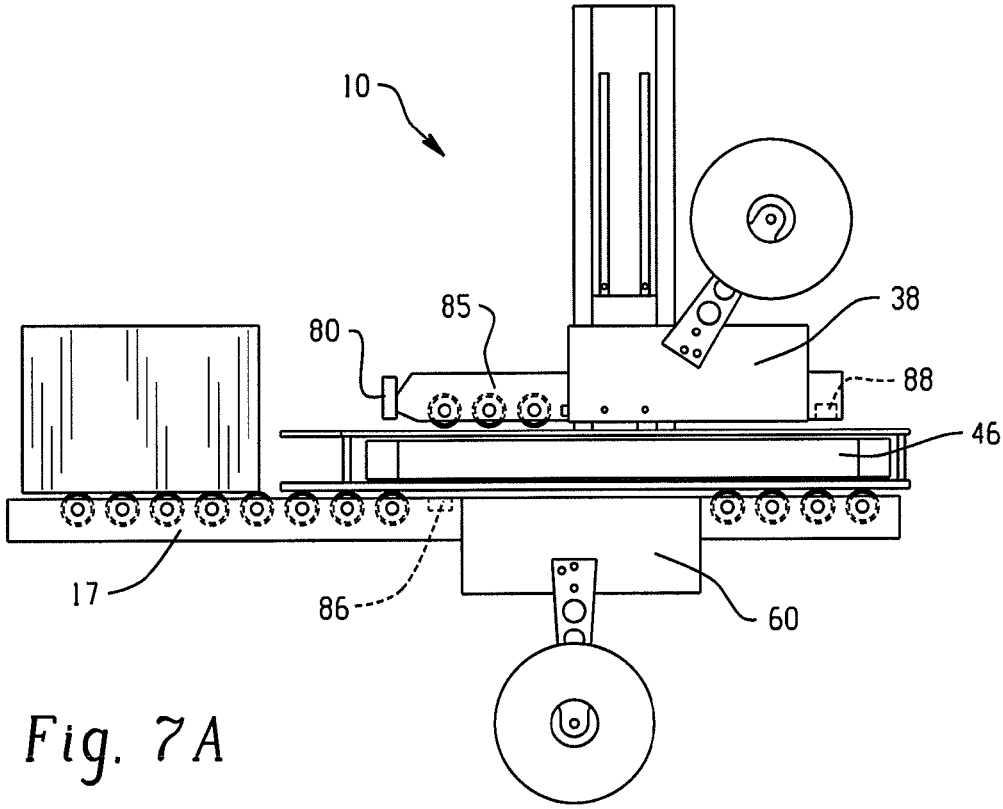
FIGS. 7A and 7B illustrate an embodiment of a method of controlling the case sealing apparatus of FIG. 1.
Figure 7B:
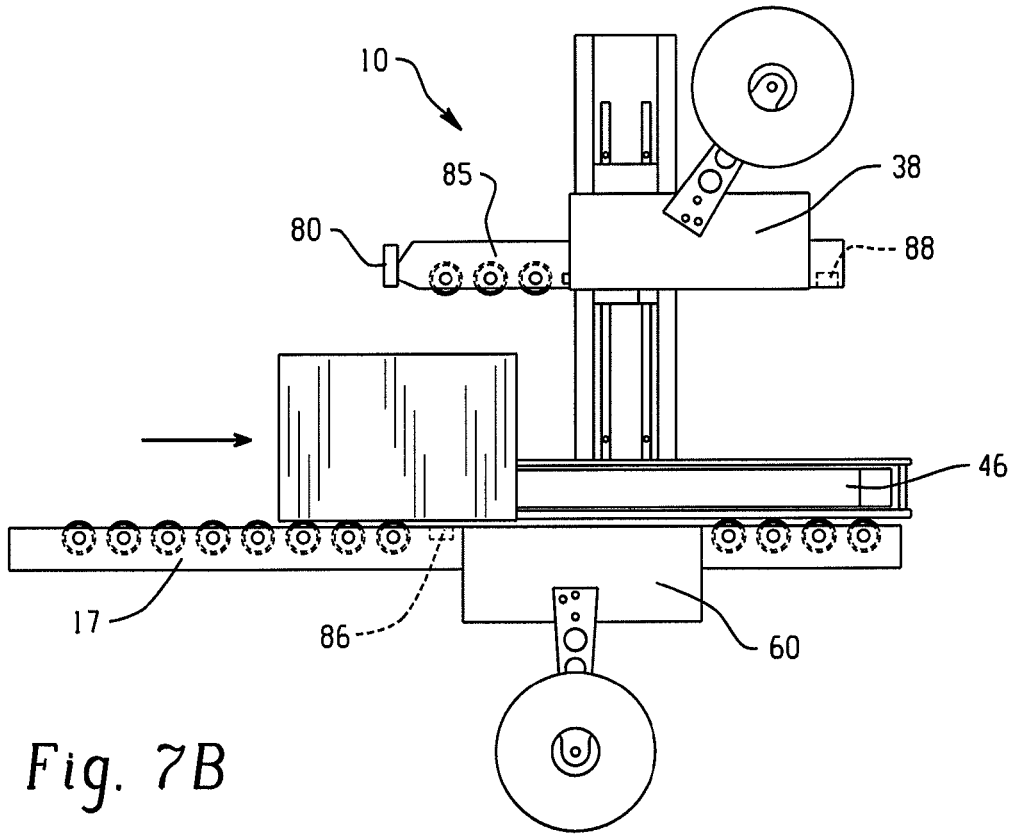

Referring to FIG. 7A, the case sealing apparatus 10 including control system operates when a case is located on the conveyor bed 17 at the infeed. Initially, the case sealing apparatus 10 may be in the multi-size case mode with the upper tape head assembly 38 at rest in its lowest position and the side conveyors 44 and 46 at rest in their fully spaced apart positions (as also shown by FIG. 1). The case is moved in the conveying direction until it is sensed by a sensor 80 (e.g., a contact sensor located at the front of the upper tape head assembly 38; see also FIGS. 1 and 2) by pushing the case against a front of the upper tape head assembly 38. In some embodiments, the sensor 80 may provide an indication to a controller that the case is sensed. When the case is detected by the sensor 80, the upper tape head assembly 38 rises upward with roller assembly 85 at the front of the upper tape head assembly facilitating movement. Referring to FIG. 7B, when the upper tape head assembly 38 is high enough, the operator pushes the case further forward, triggering sensor 86. Triggering sensor 86 causes the side conveyors 44 and 46 to move inward until they engage the sides of the case (sensors on the side conveyors may be used to detect position of the case as well). The side conveyors 44 and 46 move the case past the upper and lower tape head assemblies 38 and 60 and the case is taped along its top and bottom. An exit sensor 88 detects case throughput after which the side conveyors 44 and 46 move to their furthest spaced apart positions and the upper tape head assembly 38 descends to its lowest/start position (FIG. 7A) to handle the next case. When a following case is fed into the case sealing apparatus, the steps of FIGS. 7A and 7B are repeated for each following case. The multi-size case mode may be particularly advantageous when cases of varying dimensions are being sealed during a single run.

In some instances, it may be desired to feed cases of substantially the same dimensions through the case sealing apparatus 10. For these instances, the case sealing apparatus 10 is provided with the case size lock mode during which at least one (or both) of the elevation of the tape head assembly 38 and the positions of the side conveyors 44 and 46 relative to each other can be locked after their locations are set based on the dimensions of the case. The case lock mode can increase the throughput of similarly or same sized cases through the cases sealing apparatus 10 as compared to the multi-sized case mode because many of the steps described above are not repeated for each case.

Figure 8:
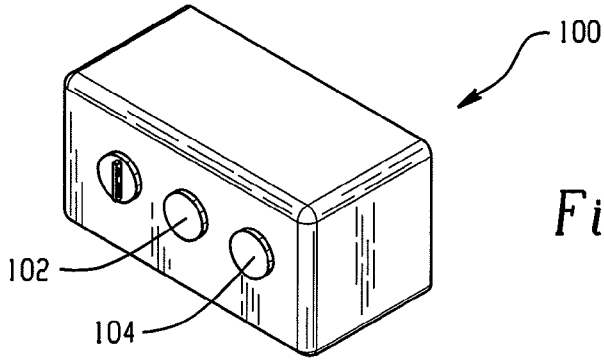
FIG. 8 is a perspective view of an embodiment of a user input device for controlling the case sealing apparatus of FIG. 1 by placing the case sealing apparatus in a case size lock mode.
Figure 9:
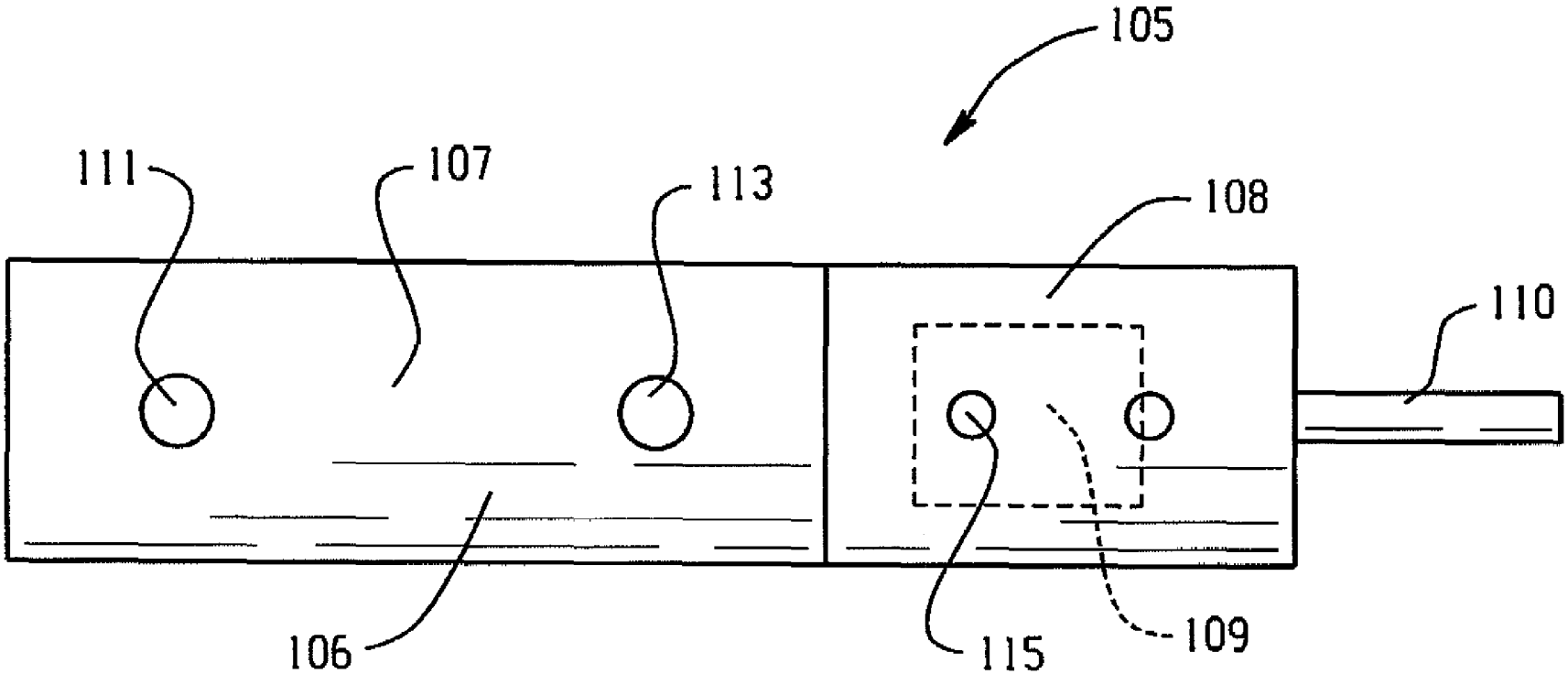
FIG. 9 is a side, diagrammatic view of an embodiment of an actuator including a lock feature for locking an output rod of the actuator at a position.

After the elevation of the upper tape head assembly 38 and the distance between the side conveyors 44, 46 are set as described above to the positions of FIG. 7B, an operator can place the case sealing apparatus 10 in the case size lock mode, for example, using a user input device 100 (FIG. 8). In one embodiment, referring to FIG. 9, the pneumatic cylinders 105 used to move the upper tape head assembly 38 and the side conveyors 44 and 46 each include an actuation section 106 and a lock section 108. The actuation section 106 includes the cylinder 107 and pneumatic line connectors 111 and 113 and the lock section 108 includes a locking mechanism 109 for locking the output rod 110 in place. In one embodiment, the actuation section 106 includes a rod lock that is spring actuated for clamping the rod thereby preventing its movement and air-released for unclamping the rod thereby allowing its movement. In one implementation, once a lock button 102 (FIG. 8) of the user input device 100 is depressed, pressurized air is no longer provided to the lock section 108 (and, in some embodiments, the actuation section 106) via air line 115 causing the locking mechanism to lock the rod in place.

Then, the cases having substantially the same dimensions as the already fed through case can be sent through the case sealing apparatus 10 without readjusting the positions of the upper tape head assembly 38 and side conveyors 44 and 46 each time a case is infed into the case sealing apparatus. Once the cases are sealed, the operator may release the case size lock mode using button 104 of the user input device 100, which causes the upper tape head assembly 30, in the illustrated example, to fully descend and the side conveyors 44 and 46 to fully retract away from each other. Although shown in isolation, the user input device 100 may be mounted to the frame 12 (see FIG. 1). In another embodiment, the user input device 100 is mounted to the upper tape head assembly 38 such that it moves vertically therewith. In some embodiments, the pneumatic cylinder 72 used to place the case sealing apparatus 10 in the tape change mode includes the actuation section 106 and the lock section 108.

Figure 10:
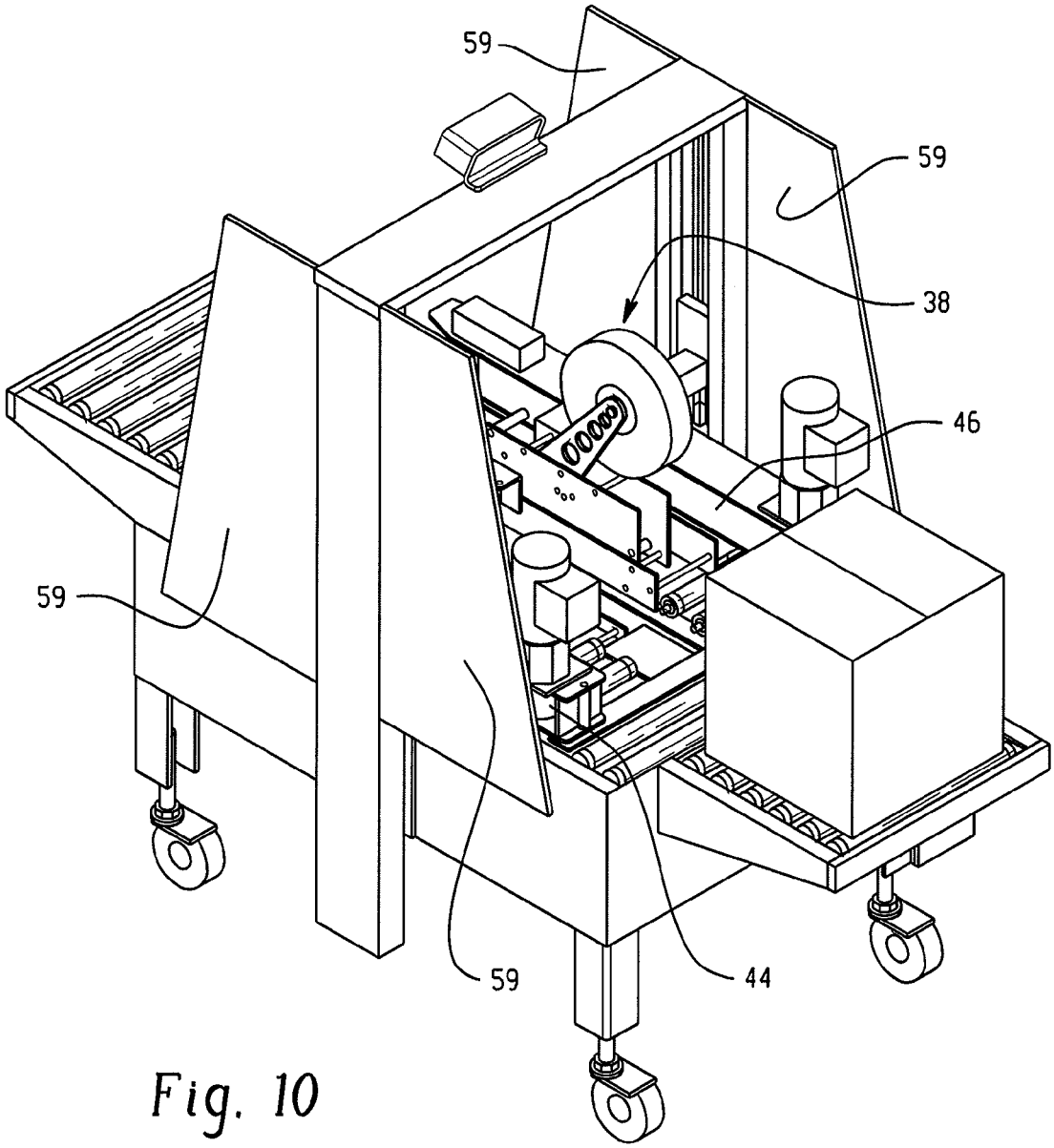
FIG. 10 is a perspective view of the case sealing apparatus of FIG. 1 with doors in a closed configuration.

Referring to FIG. 10, in some embodiments, the automated control system that sets the locations of the upper tape head assembly 38 and the side conveyors 44 and 46 may operate to move the upper tape head assembly and the side conveyors only if the doors 59 are in their respective closed configurations. If the doors 59 (or one or more of the doors) are in their open configurations as shown by FIG. 1, the upper tape head assembly 38 and side conveyors 44, 46 will not move. A proximity sensor may be provided to detect whether the doors 59 are open or closed.

It is to be clearly understood that the above description is intended by way of illustration and example only and is not intended to be taken by way of limitation, and that changes and modifications are possible. Accordingly, other embodiments are within the scope of the following claims.

What is claimed is:

1. A case sealing apparatus, comprising:

a frame structure including a case conveyance path extending from a case infeed station to a case outfeed station;

first and second side conveying units extending between the infeed station and the outfeed station, the first and second side conveying units being moveable toward and away from the conveyance path for engaging opposite sides of cases to move cases of various widths from the infeed station toward the outfeed station;

a lower tape head assembly positioned along the conveyance path to apply tape to case bottoms, the lower tape head assembly movable between a lowered position for taping and a raised position for changing tape;

an upper tape head assembly positioned along the conveyance path to apply tape to case tops, the upper tape head assembly being vertically movable to accommodate cases of various heights;

a control system for controlling movement of the first and second side conveying unit, the upper tape head assembly and the lower tape head assembly, the control system including a multi-size case mode, a case size lock mode and a tape change mode, during the multi-size case mode the control system operates such that the first and second side conveying units and the upper tape head assembly are moved each time a case is fed through the machine for taping;

during the case size lock mode the control system maintains the upper tape head assembly and the first and second side conveying units in locked positions so that multiple cases of common size can be fed through the apparatus at increased throughput as compared to during the multi-size case mode; and during the tape change mode the control system raises the lower tape head assembly from the lowered position to the raised position to facilitate changing of tape;

wherein the case size lock mode is triggered via user activation of a user input during the multi-size case mode.

2. The case sealing apparatus of claim 1 wherein the control system includes a first actuator for moving the first and second side conveying units, a second actuator for moving the upper tape head assembly and a third actuator for moving the lower tape head assembly.

3. The case sealing apparatus of claim 2 wherein each of the first actuator, second actuator and third actuator is formed by a respective pneumatic actuator that includes an actuation section and a lock section, when air pressure is not applied to the lock section, the lock section defaults to an actuator locking condition that prevents movement of the pneumatic actuator.

4. A case sealing apparatus, comprising:

a frame structure including a case conveyance path extending from a case infeed station to a case outfeed station;

first and second side conveying units extending between the infeed station and the outfeed station, the first and second side conveying units being moveable toward and away from the conveyance path for engaging opposite sides of cases to move cases of various widths from the infeed station toward the outfeed station;

a lower tape head assembly positioned along the conveyance path to apply tape to case bottoms;

an upper tape head assembly positioned along the conveyance path to apply tape to case tops, the upper tape head assembly being vertically movable to accommodate cases of various heights;

a control system for controlling movement of the first and second side conveying units and the upper tape head assembly, the control system including a multi-size case mode and a case size lock mode;

during the multi-size case mode the control system operates such that (i) the first and second side conveying units and the upper tape head assembly are located at respective initial positions until presence of a case at the infeed station is detected, (ii) the upper tape head assembly is moved vertically into a taping position for taping the top of the case and the first and second side conveying units are moved sidewardly into respective side positions for engaging opposite sidewalls of the case to move the case along the conveyance path and (iii) after taping the upper tape head assembly and the first and second side conveying units are moved back to their respective initial positions to prepare for handling of a next case; and during the case size lock mode the control system maintains the upper tape head assembly and the first and second side conveying units in locked positions so that multiple cases of common size can be fed through the apparatus at increased throughput as compared to during the multi-size case mode, wherein the case size lock mode is triggered via user activation of a user input during handling of a case in the multi-size case mode after the upper tape head assembly has moved to the taping position for the case and the first and second side conveying units have been moved into their respective side positions for the case.

5. The case sealing apparatus of claim 4, wherein the control system includes at least a first pneumatic actuator linked to move the upper tape head assembly vertically and at least a second pneumatic actuator linked to move the first and second conveying units.

6. The case sealing apparatus of claim 5, wherein:

the first pneumatic actuator includes an actuation section and a lock section, when air pressure is not applied to the lock section, the lock section defaults to an actuator locking condition that prevents movement of the first pneumatic actuator;

the second pneumatic actuator includes an actuation section and a lock section, when air pressure is not applied to the lock section, the lock section defaults to an actuator locking condition that prevents movement of the second pneumatic actuator;

when the case-size lock mode is triggered, the control system operates to prevent application of air pressure to both the actuation section and the lock section of each of the first pneumatic actuator and the second pneumatic actuator.

7. The case sealing apparatus of claim 4 wherein the user input is located on an upper portion of the frame.

8. The case sealing apparatus of claim 7 wherein the user input is located on a tape head support portion of the frame, above the upper tape head assembly.

9. A case sealing apparatus, comprising:

a frame structure including a case conveyance path extending from a case infeed station to a case outfeed station;

at least one conveying unit for moving cases from the infeed station to the outfeed station;

a lower tape head assembly positioned along the conveyance path to apply tape to case bottoms, the lower tape head assembly movable between a lowered position for taping and a raised position for changing tape;

a control system for controlling operation of the conveying unit and movement of the lower tape head assembly, the control system including at least one case sealing mode and a tape change mode; and a door connected to the frame for movement between closed and open positions, during the case sealing mode the lower tape head assembly is maintained in its lowered position as cases are moved from the infeed station to the outfeed station via operation of the conveying unit;

during the tape change mode the control system raises the lower tape head assembly from the lowered position to the raised position to facilitate changing of tape, the control system includes a sensor for detecting whether the door is closed, the control system prevents movement of the lower tape head assembly between the lowered and raised positions when the door is open.

10. The case sealing apparatus of claim 9, wherein the door is sized and arranged to be a barrier to user side access to at least part of the conveyance path.

11. A case sealing apparatus, comprising:

a frame structure including a case conveyance path extending from a case infeed station to a case outfeed station;

first and second side conveying units extending between the infeed station and the outfeed station, the first and second side conveying units being moveable toward and away from the conveyance path for engaging opposite sides of cases to move cases of various widths from the infeed station toward the outfeed station;

a lower tape head assembly positioned along the conveyance path to apply tape to case bottoms;

an upper tape head assembly positioned along the conveyance path to apply tape to case tops, the upper tape head assembly being vertically movable to accommodate cases of various heights;

a control system for controlling movement of the first and second side conveying units and the upper tape head assembly, the control system including a multi-size case mode and a case size lock mode;

during the multi-size case mode the control system operates such that (i) the first and second side conveying units and the upper tape head assembly are located at respective initial positions until presence of a case at the infeed station is detected, (ii) the upper tape head assembly is moved vertically into a taping position for taping the top of the case and the first and second side conveying units are moved sidewardly into respective side positions for engaging opposite sidewalls of the case to move the case along the conveyance path and (iii) after taping the upper tape head assembly and the first and second side conveying units are moved back to their respective initial positions to prepare for handling of a next case; and during the case size lock mode the control system maintains the upper tape head assembly and the first and second side conveying units in locked positions so that multiple cases of common size can be fed through the apparatus at increased throughput as compared to during the multi-size case mode, wherein the case size lock mode is triggered via user activation of a user input during handling of a case in the multi-size case mode after the upper tape head assembly has moved to the taping position for the case and the first and second side conveying units have been moved into their respective side positions for the case;

wherein the user input is located on and movable with the upper tape head assembly and the user input faces the infeed station.

12. The case sealing apparatus of claim 11 wherein the user input is located on and movable with the upper tape head assembly and the user input faces the infeed station.

13. The case sealing apparatus of claim 12 wherein the user input is a user actuatable button.

14. The case sealing apparatus of claim 12 wherein the lower tape head assembly is movable between a lowered position for taping and a raised position for changing tape, the control system further comprising a tape head actuator operatively connected to the lower tape head assembly for moving the lower tape head assembly from the lowered position to the raised position.

15. The case sealing apparatus of claim 14 further comprising a user input device for triggering operation of the tape head actuator.

16. The case sealing apparatus of claim 15 wherein the user input device is located on a control box located on one side of the frame.

17. The case sealing apparatus of claim 14 further comprising a door connected to the frame for movement between closed and open positions, the control system includes a sensor for detecting whether the door is closed, the control system prevents movement of the upper tape head assembly, the first and second conveying units and the lower tape head assembly when the door is open.

18. The case sealing apparatus of claim 17, wherein the door is sized and arranged to be a barrier to user side access to the conveyance path.

* * * * *